US005887468A

United States Patent [19]

Hasan

[11] Patent Number: 5,887,468

[45] Date of Patent: Mar. 30, 1999

[54] ASSEMBLY FOR RETAINING OF KEYS OR SIMILAR OBJECTS

[76] Inventor: Noam Hasan, Alia St. 27/5, Afula, Israel

[21] Appl. No.: 783,175

[22] Filed: Jan. 14, 1997

Related U.S. Application Data

[63] Continuation-in-part of Ser. No. 215,713, Mar. 22, 1994, Pat. No. 5,592,839.

[51] Int. Cl.[6] ..... A44B 15/00

[52] U.S. Cl. ..... 70/456 R; 70/460; 70/459

[58] Field of Search ..... 70/456 R, 397, 70/398, 401, 408, 456 B, 459, 460; 206/37.2, 37.5, 37.7, 37.8, 38, 38.1; 81/177 A, 490, 437–439

[56] References Cited

U.S. PATENT DOCUMENTS

| | | | |
|---|---|---|---|
| 1,996,933 | 4/1935 | Segal | 206/37.2 |
| 2,076,895 | 4/1937 | Johnston | 206/37.2 |
| 2,164,148 | 6/1939 | Swanson | 70/456 R |
| 2,533,518 | 12/1950 | Scott | 70/456 R |
| 2,560,595 | 7/1951 | Poncar | 70/456 R |
| 2,908,156 | 10/1959 | Preston | 70/456 R |
| 3,099,399 | 7/1963 | Kibby | 70/456 R |
| 3,239,233 | 3/1966 | Stillwagon | 81/438 |
| 3,457,746 | 7/1969 | Glassman | 70/456 R |
| 3,895,508 | 7/1975 | Cranianski | 70/408 |
| 3,981,169 | 9/1976 | Youd | 70/456 R |
| 4,036,040 | 7/1977 | Graizzaffi | 70/456 R |
| 4,037,439 | 7/1977 | Youd . | |
| 4,045,984 | 9/1977 | Hughes . | |
| 4,557,124 | 12/1985 | Russ | 70/456 R |
| 4,641,125 | 2/1987 | Pesa | 70/456 R |
| 4,976,175 | 12/1990 | Hung | 81/439 |
| 5,046,343 | 9/1991 | Miwa | 70/408 |
| 5,215,190 | 6/1993 | Hoffpavir | 70/456 R |
| 5,220,319 | 6/1993 | Kendel | 70/456 R |
| 5,228,363 | 7/1993 | Corona | 81/490 |
| 5,339,661 | 8/1994 | Eisermann | 70/456 R |

*Primary Examiner*—Steven Meyers
*Assistant Examiner*—Gary Estreimsky
*Attorney, Agent, or Firm*—Blank Rome Comisky & McCauley LLP

[57] ABSTRACT

A compact assembly for retaining keys or other domestic articles permits retention, rapid identification, and selection of an appropriate object by single-hand operation without the necessity of visual observation. The assembly comprises a tubular housing which can be grasped by the hand of the user, and a key retaining mechanism, a key advancing mechanism and a driving mechanism mounted within the housing. The key retaining mechanism can carry a plurality of keys, disposed in a plurality of storing stations provided with key receiving grooves. A selected key can be driven along the groove by the key advancing mechanism after the storing station corresponding to the particular key is brought into alignment with a key exit opening of the housing. The assembly can be provided with a remote control mechanism and/or alarm mechanism.

14 Claims, 18 Drawing Sheets

FIG. 1
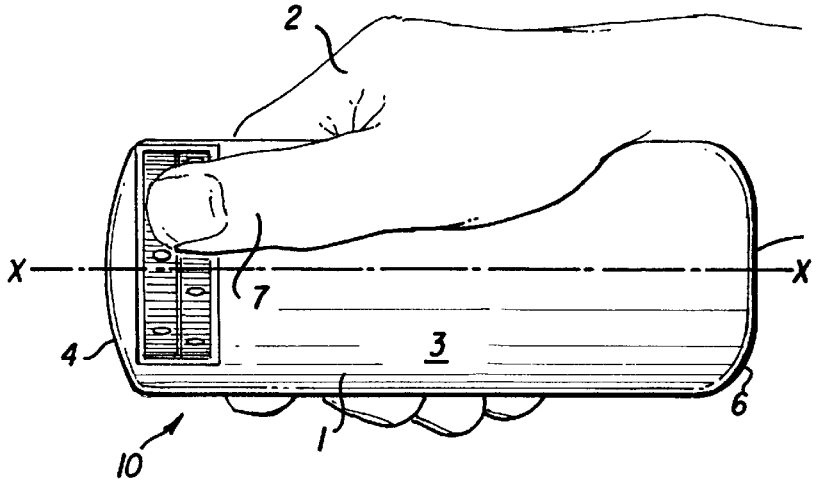
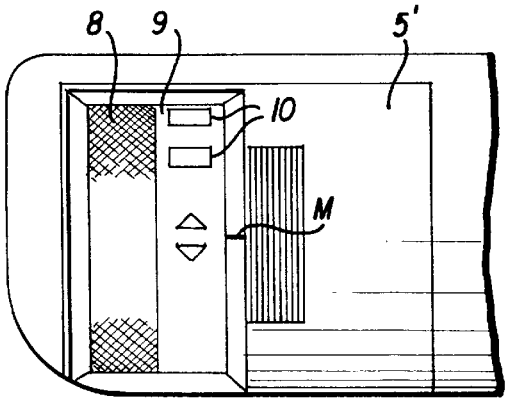
FIG. 2
FIG. 3
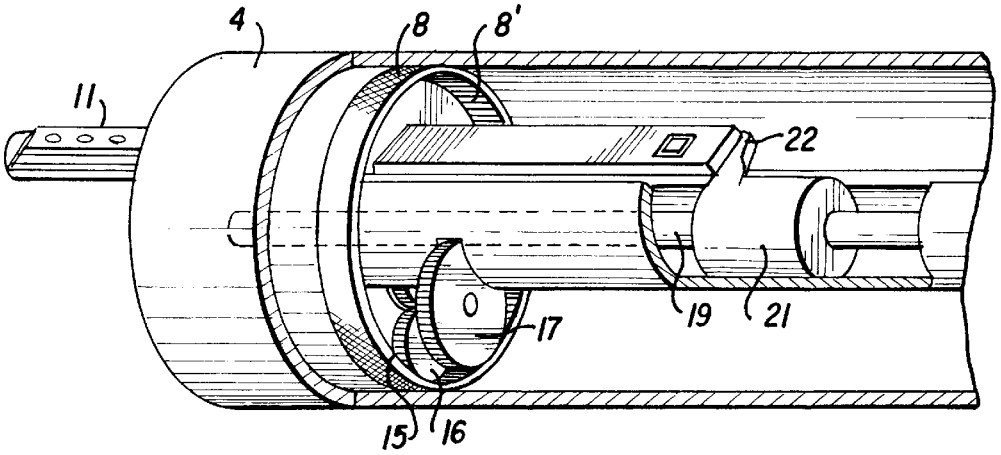

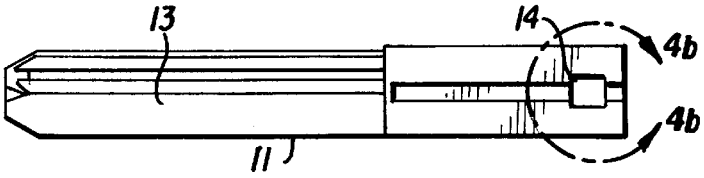
FIG. 4a
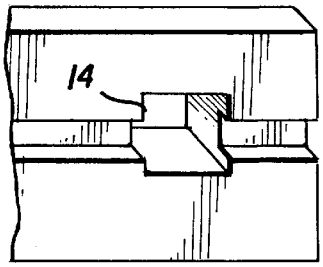
FIG. 4b
FIG. 5
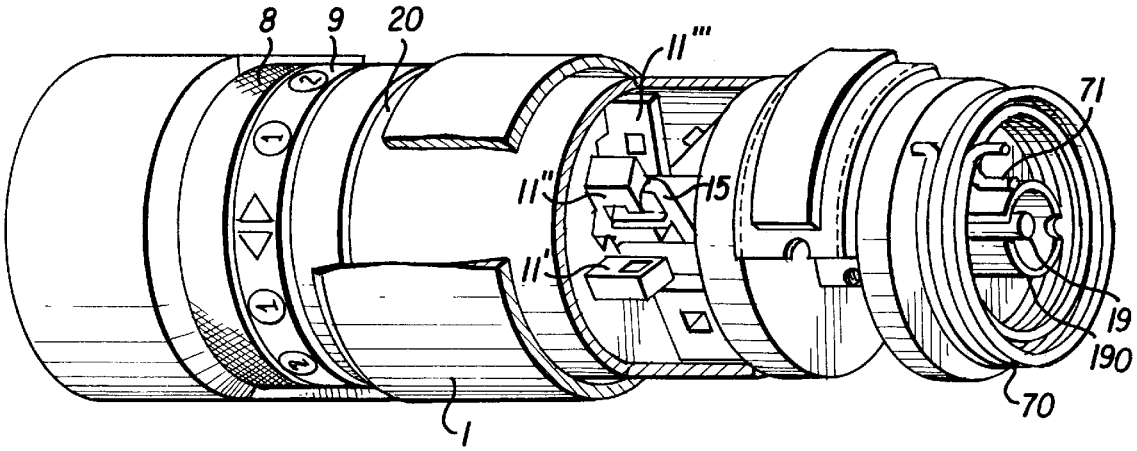
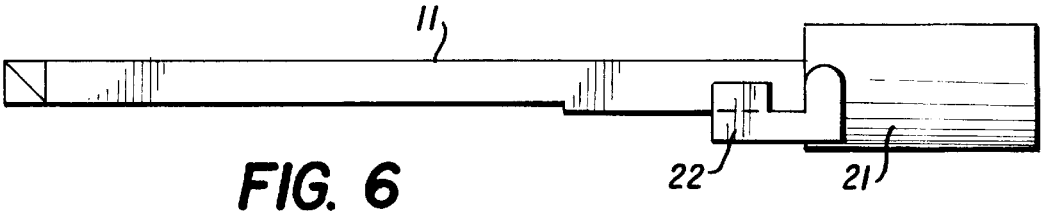
FIG. 6

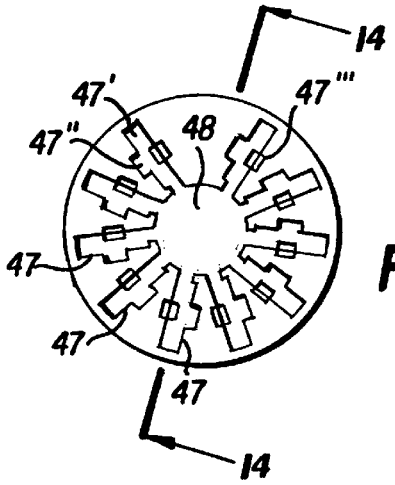
FIG. 12
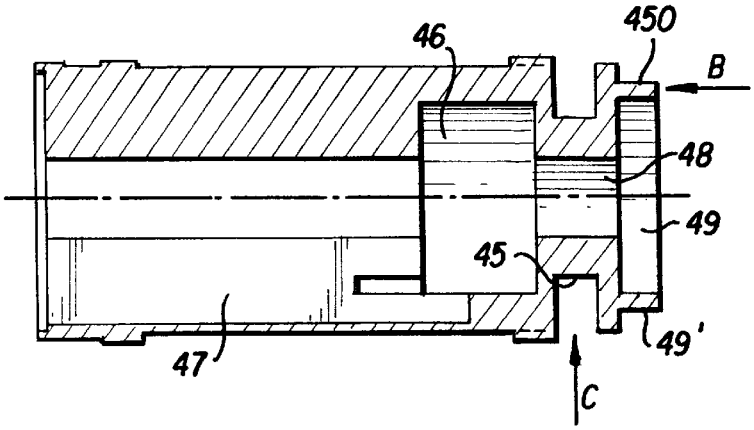
FIG. 14
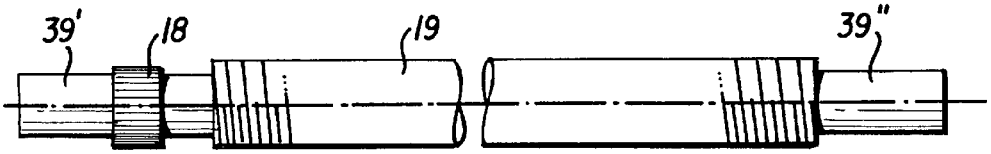
FIG. 15
FIG. 16a
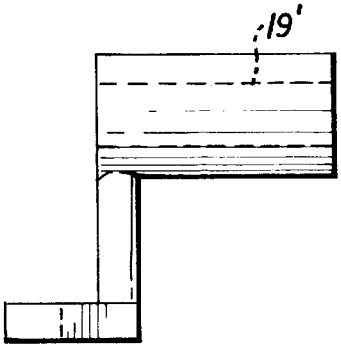
FIG. 16b
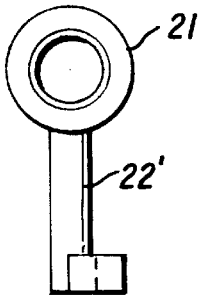
FIG. 16c
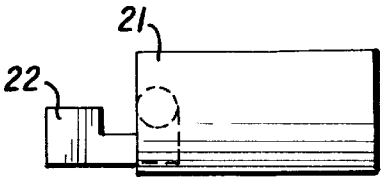

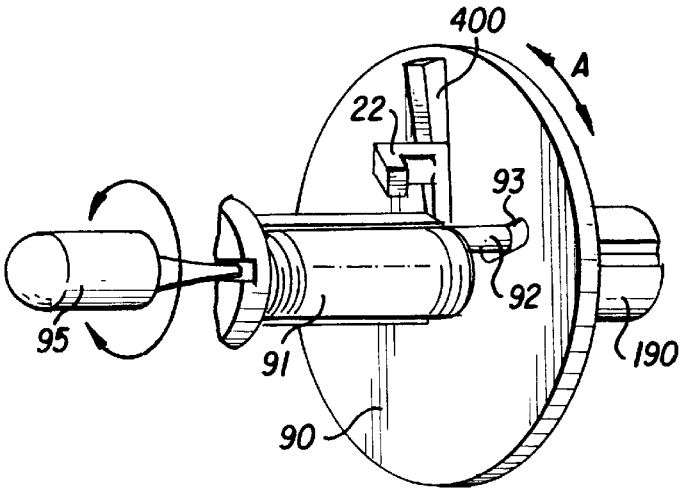
FIG. 19a
FIG. 19b
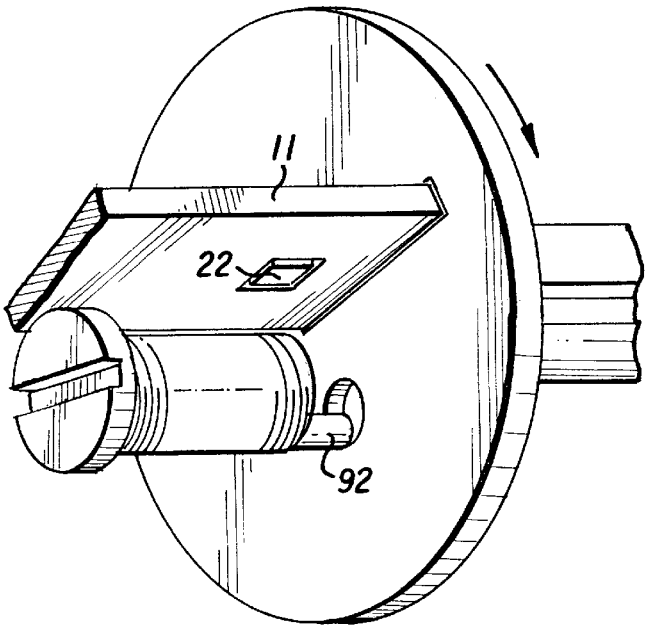
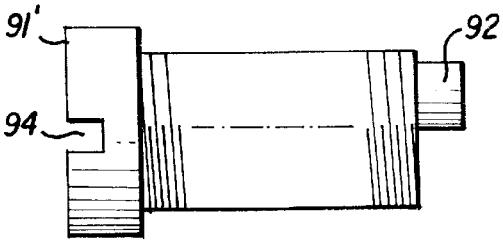
FIG. 21
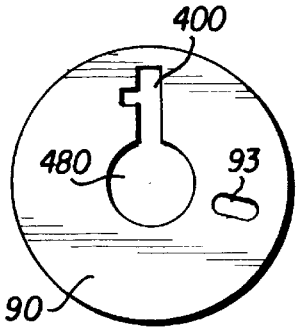
FIG. 20

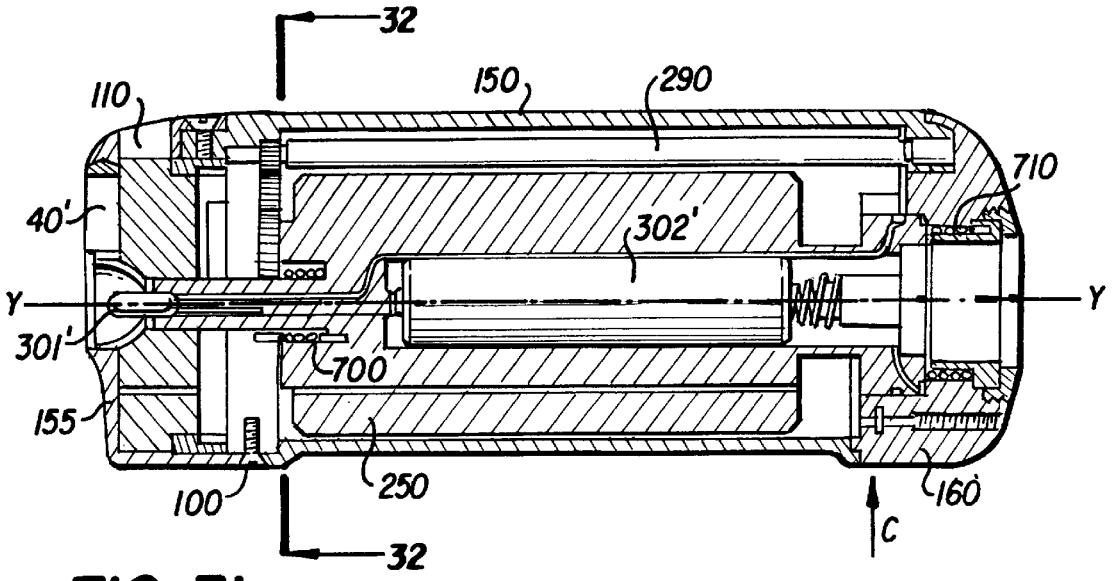
FIG. 31
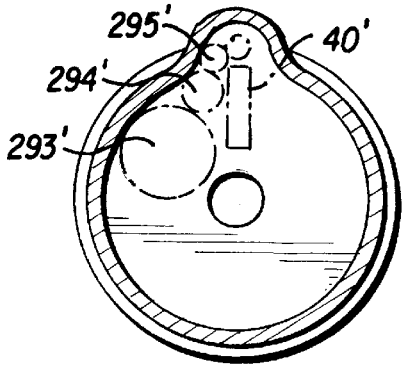
FIG. 32
FIG. 37a
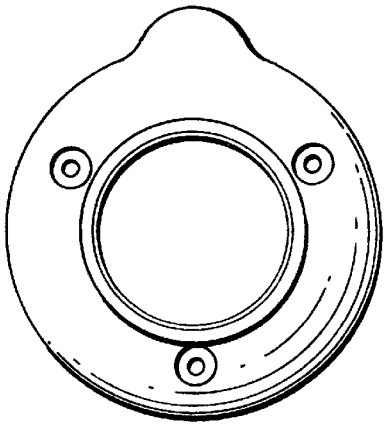
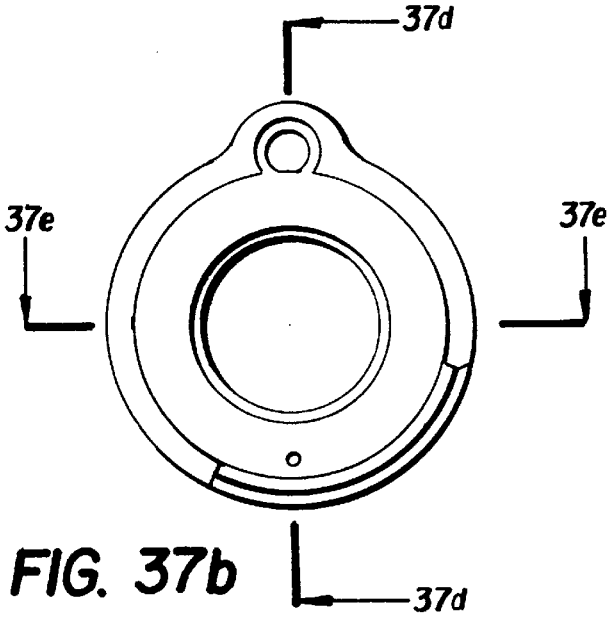
FIG. 37b

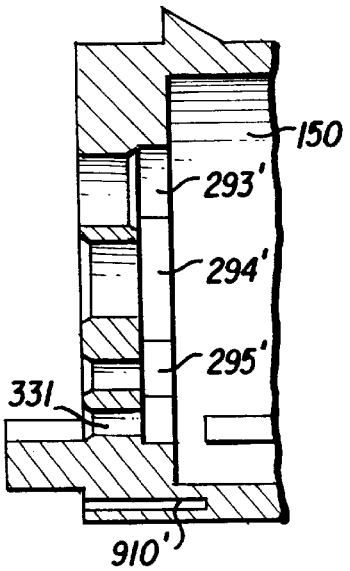
FIG. 42
FIG. 43a
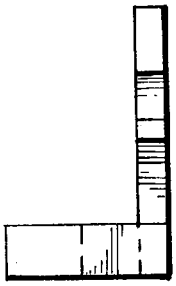
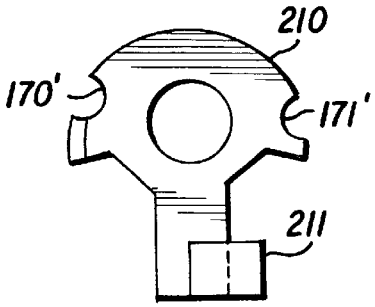
FIG. 43b
FIG. 44a
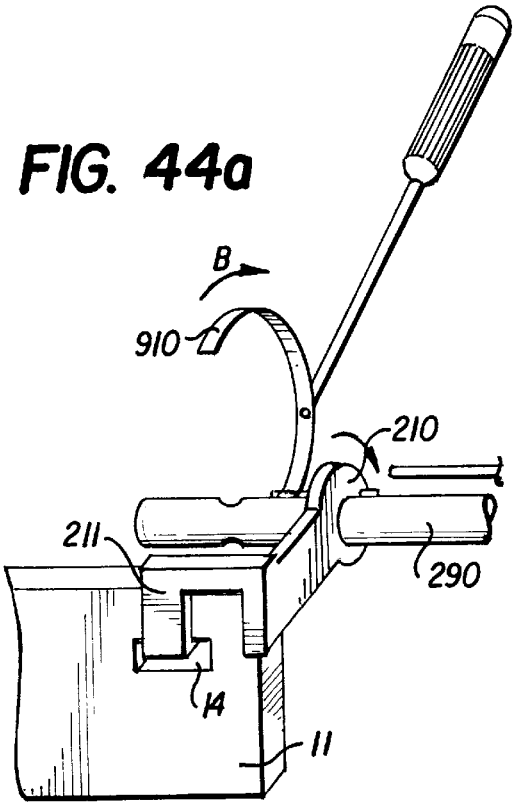
FIG. 44b
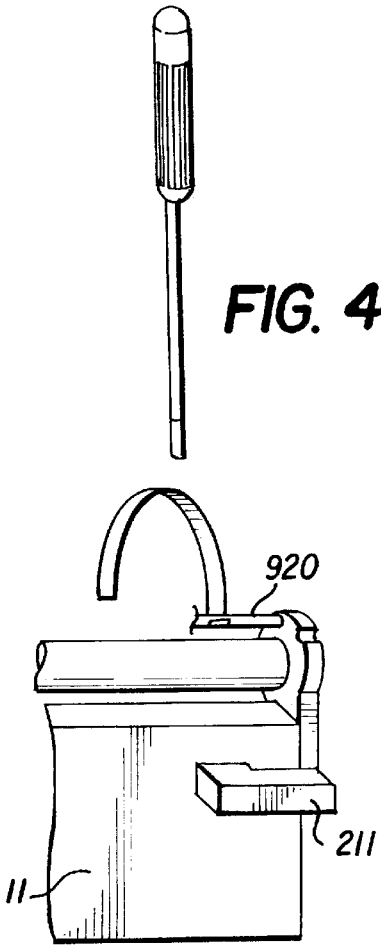

ASSEMBLY FOR RETAINING OF KEYS OR SIMILAR OBJECTS

REFERENCE TO RELATED APPLICATION

This is a continuation-in-part of Ser. No. 08/215,713 filed on Mar. 22, 1994, now U.S. Pat. No. 5,592,839 issued on Jan. 14, 1997.

FIELD OF THE INVENTION

The present invention generally relates to domestic articles or appliances, in particular to devices for retaining a plurality of small similarly shaped objects; specifically door keys.

This invention, however, is not limited to house keys and can be used for retaining other types of keys as well; for example, keys provided with a magnetic band, magnetic cards, or other tools such as screwdrivers, screwdriver tips, torque keys, etc.

BACKGROUND OF THE INVENTION

Key retainers or cases are very widely used in everyday life, and there are numerous such devices described in many patent specifications; for example, in Hughes' U.S. Pat. No. 4,045,983, McDonald's U.S. Pat. No. 4,045,984, and Youd's U.S. Pat. No. 4,037,439.

Construction of these known devices in most cases is relatively unsophisticated in the sense that it ensures only one function; namely, the storing of keys, held in a bunch.

In known key retaining devices selection of the demanded key and its movement from stored position to use position is manually allowed only after the user has made direct observation of the whole plurality of keys stored in the retainer and has visually identified and selected the proper key. In darkness, or in insufficient lighting conditions, manipulation of such retainers can be difficult and rather inconvenient, especially for weak sighted persons, since it is impossible to identify and select one of a plurality of keys without previous visual contact.

The other disadvantage of known key retaining devices is associated with the fact that their construction does not allow for fixation of the key by the holder after it is moved to a use position. In order to effect the key, for example, when it is inserted in the key way, it should be firmly grasped by the fingers. Due to this limitation, the ultimate rotational force which can be applied to the key becomes dependent on the physical ability of the person using the key and on the dimensions of the key. This might cause additional inconvenience, especially for small children or disabled persons.

Another common drawback inherent to known key retainers is that their external size is dependent on the dimensions of the keys to be stored, and in particular, on the width of the key handle. When keys with wide handles are stored, the holder becomes rather bulky, cannot be put in a pocket, and might even require manipulation by both hands.

In conclusion, it should be pointed out that, despite the existence of numerous key retaining devices, there is still a need for a new, improved, simple and convenient-to-use key retainer.

SUMMARY OF THE INVENTION

The object of the present invention is to provide a key retaining device in which the above-mentioned drawbacks are sufficiently reduced or overcome.

In particular, the primary object of the present invention is to provide a new and compact device which ensures the retaining of a plurality of keys, specifically for building doors, or the like, and the identification and selection of one of a plurality of said keys in which facility of manual control is achieved, and the entire device is operable by one hand.

The second object of the present invention is to provide a new and improved key retaining device in which rapid identification and blind automatic selection of the appropriate key is ensured, without the necessity of visual observation.

Another object of the present invention is to provide a key retaining device which enables an increase in ultimate rotational force which the user can apply to the key when the key is selected and advanced to the use position.

Still a further object of the present invention is to provide a new blank for the fabrication of keys, and a key which can be used with the new key retaining assembly.

The above and other objects and advantages of the present invention can be achieved according to the following combination of its essential features:

an assembly for retaining a plurality of keys or similar objects in a stored position, selecting of a required key, and advancing it to the use position, characterized in that it comprises a housing, formed essentially as a tubular body with a longitudinal axis, wherein said body can be grasped by a hand, the housing being defined by a front portion, provided with a key exit opening, an outwardly facing longitudinally extending circumference and a rear portion, a key retaining means, provided with a plurality of storing stations formed as longitudinally extending receiving grooves, adapted to carry a plurality of said keys with the possibility for sliding of the key along a corresponding groove, said key retaining means being mounted inside the tubular body with the possibility to be rotated about said longitudinal axis from an arbitrary initial position to a working position, so as to bring a key receiving groove of a selected storing station into alignment with the key exit opening, a key advancing means mounted inside said tubular body with the possibility to be actuated independently of said key retaining means and to interact with the selected key so as to enable its sliding along a receiving groove and advancing from the stored position to the use position or vice versa via said exit opening, a driving means adapted to interact with said key advancing means and/or said key retaining means.

In accordance with one of the preferred embodiments, said key advancing means comprises an axle which extends along said housing and is mounted with the possibility for its rotation and said axle carries a retracting member, preferably formed as pivotably mounted on said axle hook, and adapted to grab the selected key and to advance it along the receiving groove of said key retaining means in response to the rotary motion of said axle, and said assembly comprises a guiding means adapted to direct said retracting member when it advances the selected key toward the use position and to disengage it from the key after it is returned to the stored position, and said assembly comprises a disconnecting means adapted to separate said retracting member from the key when the key is moved out of the exit opening into the use position.

According to another preferred embodiment, said housing is provided with an access window which allows direct access to a grasping hand both to said key retaining means and to said key advancing member, so as to enable their actuation; said assembly comprising a locking member essentially formed as a spring-loaded pin adapted to interact with said key retaining means so as to ensure its fixation when the selected storing station is brought into alignment with the key exit opening and to allow its continuous rotation when said locking member is released and said key retaining means returns to its initial position; said driving means is formed as a pair of spring elements which are adapted to be raised when said key retaining means is rotated until the selected storing station approaches a working position and to return the key retaining means to its initial position when said locking member is released.

In still another preferred embodiment, said key advancing means is provided with a ring-like portion, the outwardly facing surface of which can be accessed through said access window and rotated by a grasping hand while its toothed inwardly facing surface meshes with the set of intermediate gears transferring the rotary motion of said ring-like portion to a pinion which is mounted on said axle.

In a further preferred embodiment, said locking member is provided with a knob control mechanism which is adapted to release said locking member so as to allow return of said key retaining means to its initial position.

In yet another preferred embodiment, said set of spring elements comprises two coil springs which interact with the key retaining means.

In accordance with a further preferred embodiment, said guiding means is formed as an elongated slotted tube which extends from the interior of said front portion of said body towards its rear position, said axle being mounted inside said slotted tube and said retracting member being mounted on said axle with the possibility to be guided by the slot of said tube.

In still another preferred embodiment, said coiled springs are mounted concentrically adjacent to the rear portion of said body.

In another preferred embodiment, said guiding means is formed as two projections made on an inwardly facing circumference of said body and extending along it, said retracting member being provided with two depressions mating with said projections, and said axle being mounted eccentrically with respect to the longitudinal axis of said body.

In a further preferred embodiment, said coiled springs are mounted separately, one of the springs being located near the front portion of said body and the second being located near the rear portion of said body.

In accordance with a further preferred embodiment, said access window is located adjacent to the front portion of said body, and said knob control mechanism near its rear portion.

In another preferred embodiment, said assembly is provided with a light bulb mounted on the front portion of said body.

In yet another preferred embodiment, said knob control mechanism is adapted to switch said light bulb on or off.

In an alternative preferred embodiment, said assembly is provided with a remote control means and/or alarm means.

In still a further preferred embodiment, said remote control and/or alarm means are assembled in a detachable compartment which is mounted on the rear portion of said body.

In accordance with another alternative preferred embodiment, said key retaining means is provided with a ring-like portion which has a toothed inwardly facing surface, and said driving means is formed as two miniature motors carrying toothed wheels, the toothed wheel of said first motor meshing with the toothed inwardly facing surface of said key retaining means, and the toothed wheel of said second motor gearing with a pinion which is mounted on said axle.

According to one of the alternative embodiments, said motors are connected with an autonomous source of energy and are placed in the detachable compartment which is mounted on the rear portion of said body, while said assembly is provided with a control means which enables operation of said motors.

In a further alternative embodiment, said control means includes separate switches for activation of said motors, light bulb, remote control and alarm means, and said switches are assembled on the same panel which is located on the outwardly facing circumference of said housing.

In accordance with a further preferred embodiment of the present invention, a new key is provided essentially for use with the new key retaining assembly, and a blank for its fabrication which is formed as an elongated, preferably flat body, defined by a frontal extremity reserved for a ward or magnetic band, and a rear extremity provided with an opening which enables engagement with the retracting member of said key advancing means.

The present invention in its various embodiments has only been briefly summarized. For a better understanding of the present invention and its advantages, reference will now be made to the following description of its preferred embodiments, taken in combination with accompanying drawings.

BRIEF DESCRIPTION OF THE DRAWINGS

FIG. 1 is a schematic isometrical view of the assembly according to the present invention, when it is grasped manually.

FIG. 2 is a partial side view of the frontal portion of the key assembly shown on FIG. 1.

FIG. 3 is a partial isometrical view illustrating operation of the key advancing means.

FIGS. 4*a,b* correspondingly present the side view of the key for use with the assembly according to the present invention, and an enlarged isometrical view of the rear extremity of the key.

FIG. 5 is a partial isometrical enlarged view of the key retaining means, knob control mechanism and coiled springs, according to one of the preferred embodiments of the present invention.

FIG. 6 shows how the retracting member engages the key.

FIG. 12 shows the left side view of the key retaining means shown in FIG. 11.

FIG. 14 is a cross-sectional view of FIG. 12 taken along line A—A in FIG. 12.

FIG. 15 is a frontal view of the axle.

FIGS. 16*a,b,c* show different views of the retracting member.

FIGS. 19*a,b* is a schematic presentation of the disconnecting means employed in the first preferred embodiment of the present invention.

FIG. 20 is a left side view of a disc which is employed in the disconnecting means shown in FIGS. 19*a,b*.

FIG. 21 is a frontal view of a screw which interacts with the disc shown in FIG. 20.

FIG. 31 is a cross-sectional view of the assembly according to the second preferred embodiment of the present invention.

FIG. 32 is a left side view of the front portion of the assembly as shown in FIG. 31.

FIG. 42 is an enlarged partial cross-sectional view of the frontal portion of the housing which is employed in the second preferred embodiment of the present invention.

FIGS. 43*a,b* show the retracting member which is employed in the second preferred embodiment of the present invention.

FIGS. 44*a,b* is a schematic presentation of the disconnecting means employed in the second preferred embodiment of the present invention.

DESCRIPTION OF THE PREFERRED EMBODIMENTS

Figure 7:
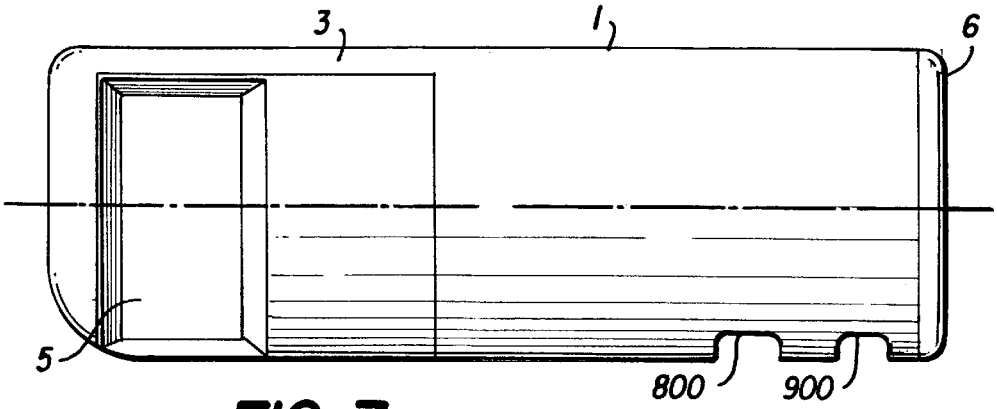
FIG. 7 presents an exterior view of the housing employed in the assembly according to the present invention.

With reference to FIGS. 1,2,3 the assembly 10 for retaining of keys is shown, in which housing 1 is grasped by a hand 2.

Housing 1 of assembly 10 is formed as a tubular, preferably cylindrical body having a longitudinal axis X—X, said body being defined by a central portion 3, extending along said axis, frontal portion 4 and rear portion 6.

At the frontal portion 4 of the body is an access window 5 equipped with a sliding cover 5' which can be moved longitudinally by a finger 7 to open the window and allow access to the interior of the body.

Inside the access window 5, two surfaces 8 and 9 can be seen and can be accessed and touched by the finger 7. The surface 8 is preferably grated so as to allow better contact with the touching finger. The surface 9 is provided with identification digits 10 for designation of a particular key to be retained inside the assembly. A marking line M is provided on the window frame.

The significance of these surfaces will be further explained with reference to the other components of the assembly and by way of explanation of the principle of operation of the assembly according to the present invention.

With reference to FIGS. 3 and 5, the plurality of keys 11, 11', 11", 11"' is retained inside the tubular housing 1 in stored position with the possibility of being moved out of the housing to a use position. An exit opening 40 is provided on the frontal portion 4 of the housing so as to allow exit of the selected key.

The keys are stored in the key retaining means, formed as a drum 20, mounted inside the housing and having a plurality of storing stations arranged in the drum in such a manner that each key is located radially while extending along the longitudinal direction of the housing.

The key retaining drum is mounted in the housing with the possibility of being revolved about axis X—X, so as to align the particular storing station carrying the selected key with the exit opening. The selected key can be advanced toward the use position and moved out via the exit opening 40 by virtue of the key advancing means provided in the housing.

FIG. 3 shows key 11 advanced to the use position after being moved out of its storing station while the rest of the keys (not shown) are stored inside the assembly.

In principle, the number of storing stations, and therefore number of keys, which can be retained in the assembly at a time depends on the outside dimension of the key to be retained. In order to keep the overall dimension of the assembly as compact as possible, similar keys, shaped as shown in FIGS. 4*a,b*, can be advantageously employed. In FIG. 4*a*, an elongated, preferably flat key 11, is presented, which is provided with a ward 13 at its frontal extremity and with a hole 14 on its rear extremity.

Figure 18:
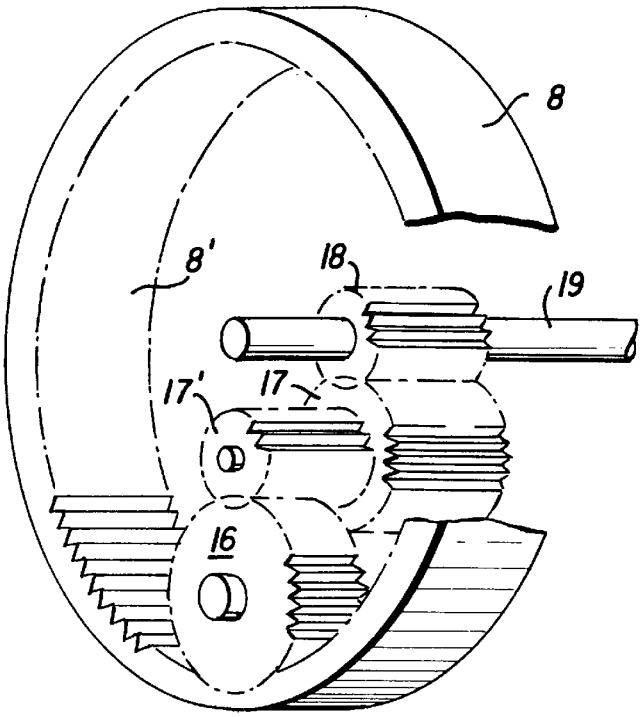
FIG. 18 is a partial isometrical view showing the transfer of rotary motion from the inwardly facing surface of the driving member to the axle.
Figure 22:
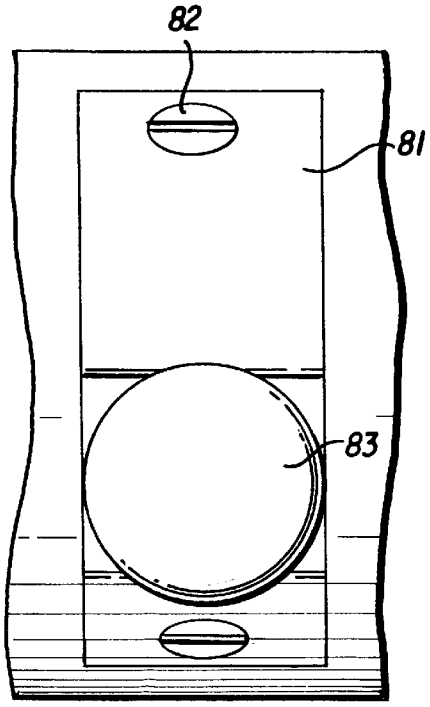
FIG. 22 is an enlarged partial frontal view of the knob control mechanism.
Figure 23:
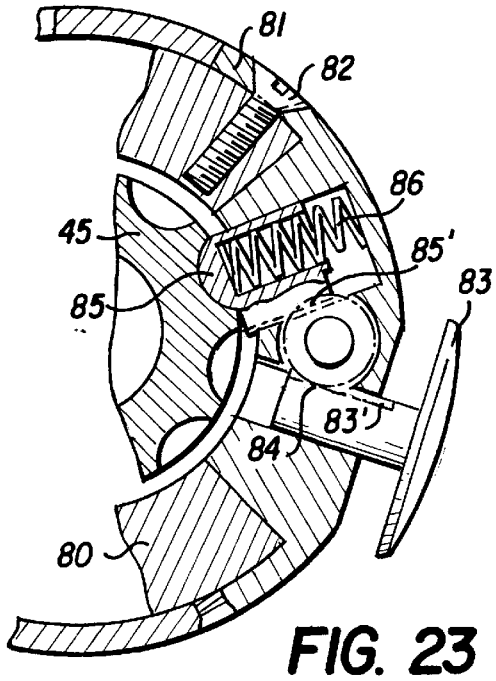
FIG. 23 is a cross-sectional view of the locking member with knob control mechanism shown in FIG. 22.
Figure 24:
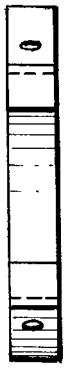
FIGS. 24,25 are front and side views, respectively, of the saddle-shaped element employed in the first preferred embodiments for mounting the locking member in the housing.
Figure 25:
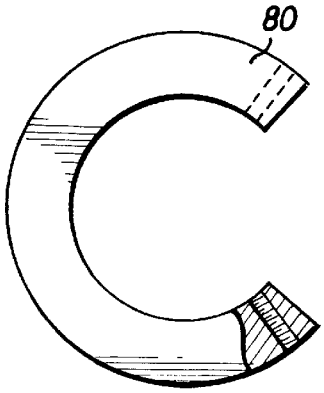
Figure 26:
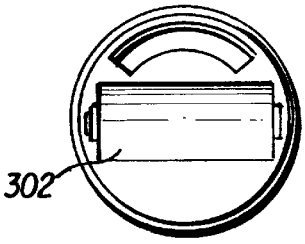
FIG. 26 is a right side view of a rear plug with a battery mounted in the housing.
Figure 27:
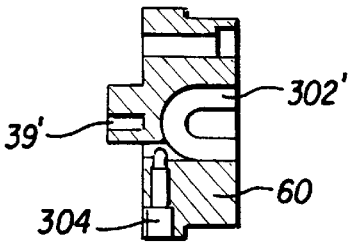
FIG. 27 is a cross-sectional view of the plug shown in FIG. 26.
Figure 28:
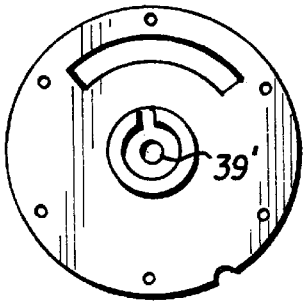
FIG. 28 is a left side view of the plug shown in FIG. 26.
Figure 29:
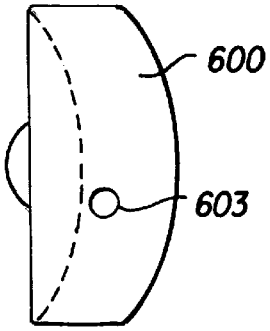
FIGS. 29,30 show the outside and cross-sectional views, respectively, of the detachable rear cover which contains the remote control means according to one of the preferred embodiments of the present invention.
Figure 30:
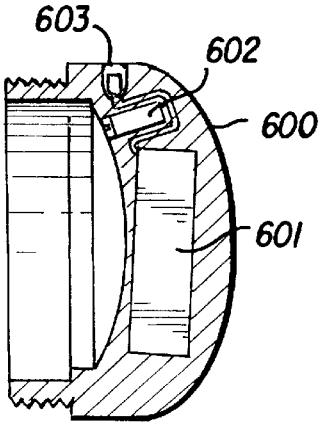

With reference to FIGS. 3 and 18, the key advancing means comprises a driving ring 15 which is defined by a grated outwardly facing surface 8 and a toothed inwardly facing surface 8'. Once the driving ring is rotated, for example by a finger, approaching surface 8 through access window 5, the rotary motion is transferred to a set of toothed wheels 16,17,17', meshing with surface 8', and further via pinion 18 to a threaded axle 19, mounted inside the housing. Axle 19 carries retractor 21, formed as a screw, gearing with the axle thread, and therefore transformation of the rotary motion of the axle into the linear movement of the retractor is provided. Retractor 20 is provided with a hook 22, which grabs the key through a hole 14, when the key occupies a working position corresponding to its disposition vis-a-vis the exit opening (see FIGS. 5,6). By means of this hook, the key can be advanced along the axle from a storage position to a use position in response to rotation of the driving ring 15.

Surface 9 is formed integrally with the key retaining drum 20; its rotation, e.g., by means of a touching finger, effects the revolving of the entire drum with all storage stations.

By virtue of identification digits 10 on surface 9, it is always possible to know which of the working stations is currently in alignment with the key exit opening. This condition corresponds to vis-a-vis disposition of a particular digit with respect to the marking line M. By touching surface 9 and by step-wise revolving of the drum clockwise or counterclockwise, each of the digits can be deliberately put opposite the marking line M advising which of the working stations carrying the selected key is brought into alignment with the key exit opening.

Rotation of key retaining drum 20 and driving ring 15 is effected independently by touching surface 9 or 8.

The above-explained general principles of the operation of the key retaining assembly can be implemented in different embodiments. Following is a more detailed description of the first embodiment.

FIGS. 7–10 show a hollow elongated tubular body 1 which has access window 5 on its outwardly facing circumference 3 and is provided with exit opening 40 on its frontal portion 4, formed integrally with the body. Configuration of opening 40 should correspond to the cross-sectional configuration of the key so as to allow its exit from the stored position to the use position. FIG. 10*a* shows the rectangular configuration of the exit opening, similar to that of the key 11; however, it should be understood that this configuration is not limited to a rectangular shape and might also be of circular or any other shape so as to allow the retention of keys or other objects with alternative cross-sectional configurations.

The body 1 has room 200 for placement of the key retaining drum 20 while its frontal portion 4 is provided with a circular niche 80 for the placement of driving ring 15 of the key advancing means and with a cylindrical recess 39 for mounting of the axle 19.

The rear portion of the body is open, and its inwardly facing surface 6' is threaded so as to enable insertion of rear plug 60 and its closing by closure 60'.

The outwardly facing surface of the rear portion of the housing is formed with two windows 800 and 900. The significance of these windows will be explained later on with reference to the functioning of the locking member and light bulb.

Figure 10A:
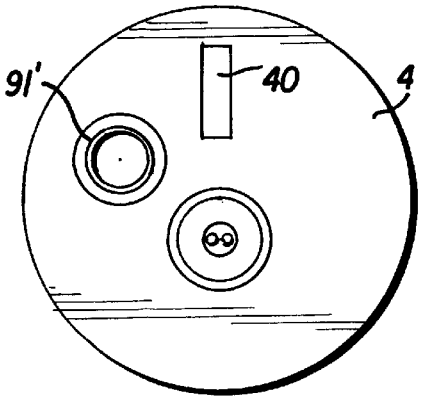
FIGS. 10*a,b,c* correspondingly present inside, outside and cross-sectional views of the frontal portion of the housing.
Figure 10B:
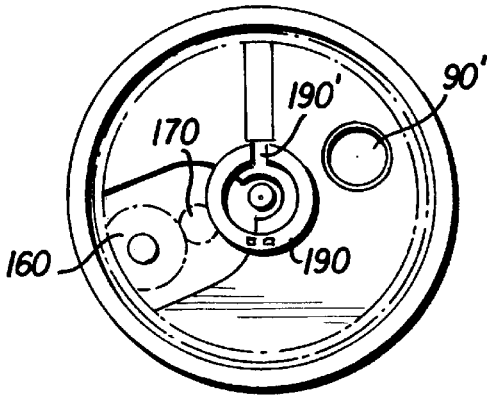
Figure 10C:
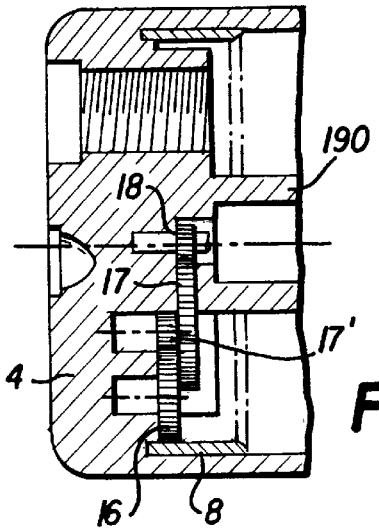

As can be seen on the inside view of the housing as presented in FIG. 10*b*, depressions 160, 170 are provided on the frontal portion 4 for retaining the toothed wheels 16, 17'.

Elongated tubular element 190, which is formed integrally with the frontal portion 4, is provided inside the hollow body 1. This element is adjacent to the frontal portion and extends from it toward the rear plug 60 while being coaxial with axis X—X. The circumference of the tubular element has two straight slots 190', 90", which extend along it and merge via the intermediate curvilinear slotted section 190". The significance of these slots will be explained later on with reference to the functioning of the key advancing means employed in this embodiment.

With reference to FIGS. 11–14, construction of the key retaining means will now be explained. The key retaining means is formed as a cylindrical drum 20, Provided with two projections 20', 20" on its circumference, so as to ensure concentrical disposition of the drum with respect to the housing after it is inserted in the room 200 through the open rear portion of the body.

Surfaces 20', 20' serve as sliding bearings as well, enabling easy rotation of the drum about its axis inside the body.

Adjacent to surface 20' is cylindrical surface 9 which can be accessed via the access window after the drum is put into the housing; adjacent to surface 20' is the neck portion 45 which carries a series of spherical depressions 50, corresponding to the storage stations which are formed in the drum. The neck portion terminates at cylindrical portion 450 which has a larger diameter than the neck portion.

There is provided cylindrical opening 48 in the drum. As can be see in FIG. 12, the interior of the drum is divided into a plurality of receiving slots 47. These slots emanate radially from opening 48 and extend along the drums so as to provide storing stations for the plurality of keys to be retained.

Besides these slots, an intermediate compartment 46 is also provided for the retractor. Cylindrical portion 450 is defined by inwardly and outwardly facing cylindrical surfaces 49, 49'. The significance of these surfaces will be explained further with reference to the interaction of the driving means with the drum.

As can be see in FIG. 12 all storage stations have a similar T-shaped cross-sectional configuration defined by rectangular main portion 47', which corresponds to the cross-section of stored keys and by a side branch 47', so as to provide room for the movement of hook 22 of the key advancing means.

The cross-sectional configuration of the receiving slots and its dimensions are to be chosen so as to enable easy sliding of the key along the respective receiving slot. Sliding can be effected by hook 22 after selected station is brought into alignment with the exit opening 40. At the same time, in order to ensure reliable retaining of the key in the storage station during its advancement, a space 47" for a spring means (not shown) can be provided, so as to ensure slightly pressing the key to a slot wall.

Referring to FIGS. 15 and 16, an axle 19 of the key advancing means is formed as a rod which consists of an elongated threaded middle part and two unthreaded extremities 39', 39'. By virtue of these extremities, the axle can be rotatively mounted in the housing in appropriate cylindrical recesses 39,39', respectively provided in the frontal portion 4 and in the rear plug 60. The axle is mounted inside the tubular element 190 and can be rotated by means of a pinion 18 provided on its extremity 39'.

The cylindrical retractor 21 is provided with an inner thoroughgoing bore which enables its mounting on the axle 19. By virtue of the inner thread 19' in the bore, there is ensured longitudinal and pivotal movement of the retractor with respect to the threaded middle part of the axle in response to its rotation. Retractor 21 is formed with radially extending arm 22', terminating by hook 22 so as to grab key 11 via opening 14 provided in its rear part.

Figure 17A:
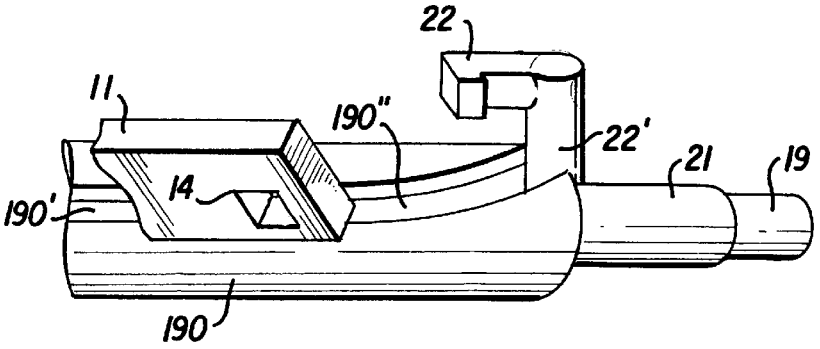
FIGS. 17*a,b* show the disengaged and engaged conditions, respectively, of the key and retracting member guided by the slotted tubular element.
Figure 17B:
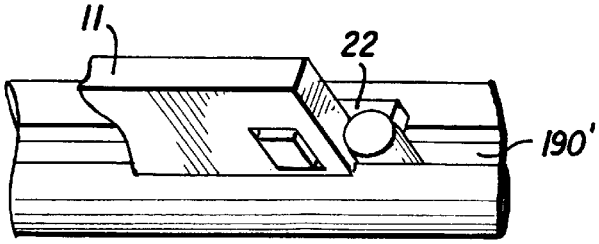

The functioning of the key advancing means will now be explained with reference to FIGS. 17*a,b* and 18. Retractor 21 is mounted on the axle 19 in such a manner that its arm 22' is inserted inside the slotted portion of the tubular element 190 so as to enable its guiding along the axle when the axle is rotated by means of the driving ring 15 and set of toothed wheels 16,17',17,18. FIG. 17*b* shows how hook 22 grabs key 11 and retractor 21, and is ready to advance it along slotted section 190' forward or backward, depending on the rotation direction of the ring 15. FIG. 17*a* shows retractor 21 being disengaged from the key by virtue of the intermediate curvilinear slotted section 190', guiding arm 22' and pivoting retractor about the axle.

Figure 8:
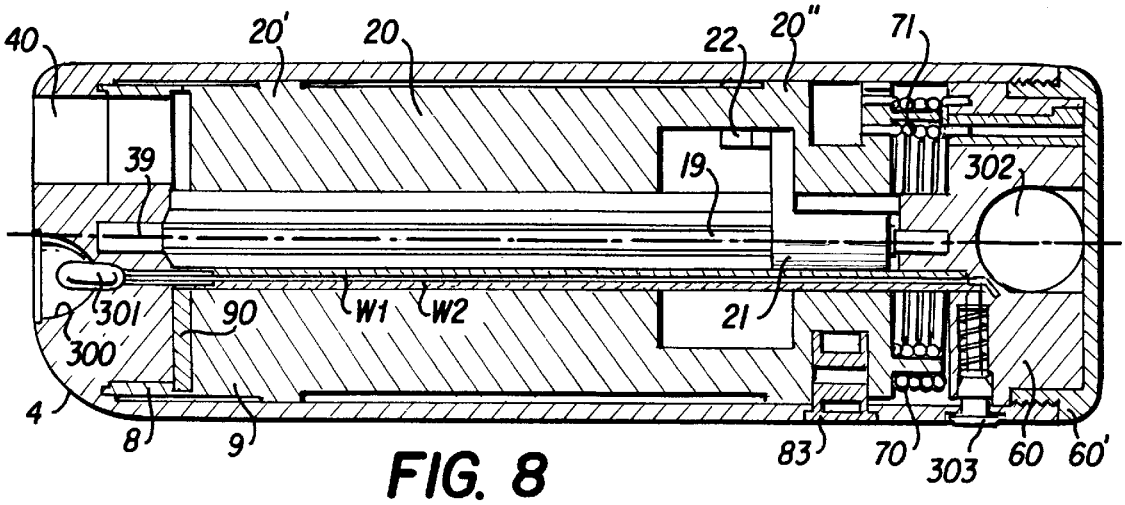
FIG. 8 shows a cross-sectional view of the assembly according to the present invention.
Figure 9:
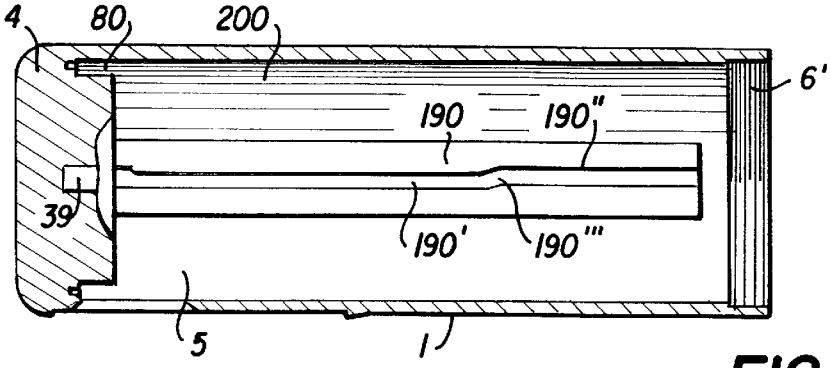
FIG. 9 shows a cross-sectional view of the housing.
Figure 13:
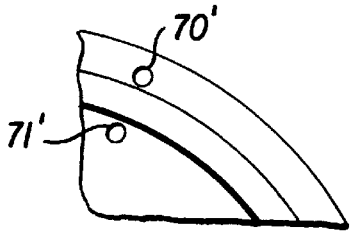
FIG. 13 is a side view of fragment B, which is circled in FIG. 11.
Figure 11:
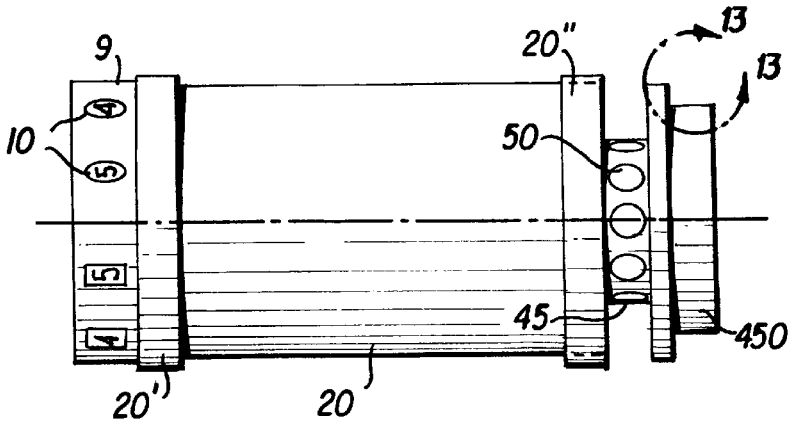
FIG. 11 shows the frontal view of the key retaining means according to the first preferred embodiment of the present invention.

With reference to FIGS. 5, 8, and 13 the functioning of the driving means employed in the first embodiment will now be explained. This means consists of two coiled springs 70, 71 mounted on the key retaining drum 20 adjacent to the rear plug 60. The purpose of these springs is to return the drum to its initial position after the drum was rotated to its working position so as to align the key exit opening 40 with the receiving slot 47' of the selected storing station.

The spring 70 is situated on the outwardly facing surface, 49' whereas one of its ends is put in depression 70', provided on this surface, and the other end is put in an appropriate depression provided in the plug. The spring 71 is mounted on inwardly facing surface 49, concentrically with spring 70; one of its ends is put in depression 71' on this surface, while its second end is put in the appropriate depression in the plug. Both springs are assembled in such a manner that rotation of the drum causes compression of one of the springs and stretching of the other. By virtue of this disposition, a counterclockwise springing reaction occurs, ensuring more reliable and always accurate return of the drum to its initial position.

In order to ensure fixation of the drum in any arbitrary position, provision is made for a locking member with pin 85, pressed by spring 86 to one of the spherical depressions 50 on the neck portion 45 located opposite the pin.

The locking member comprises knob 83, formed with toothed stem 83', meshing with pinion 84. By virtue of teeth 85', provided on the pin and meshing with the same pinion, pressing of the knob causes the pin to move backward, thus unlocking the depression and releasing the drum.

The knob, pinion and locking pin are assembled in the body portion 81 of the locking member, mounted by means of screws 82 on saddle-shaped element 80. The knob can be accessed through window 800 on the rear portion of the housing.

The functioning of the key-separating means will now be explained with reference to FIGS. 19–21. The purpose of this means is to disconnect the key from the hook, when it is advanced to the use position so as to enable removal of the key from the assembly and its replacement by another key to be retained in the same storage station. This key-separating means consists of disc 90 and screw 91 to be mounted in the housing between the drum and front portion of the body.

Disc 90 has a circular opening 480 for mounting on the tubular element 190. The diameter of the opening slightly exceeds that of the tubular element so as to enable clockwise or counterclockwise turning of the disc, as shown by arrow A in FIG. 19*a*. The circular opening 480 merges with rectangular opening 400, the configuration of which corresponds to the cross-sectional configuration of the receiving slots 45. By virtue of this configuration, the hook, while advancing the key, passes over this opening when the key approaches its use position. Ring 90 has another opening 93 situated eccentrically with respect to opening 480.

The screw 91 is provided with a corresponding eccentric finger 92, which interacts with opening 93 of the disc after the screw is screwed in via opening 90' in the frontal portion 4. The opposite end 91' of the screw can be accessed from the outside.

If the screw 91 is turned, e.g., by means of a screwdriver 95 inserted in slot 94, the finger 92 will rotate disc 90 in the same direction while pivoting hook 22 about the tubular element 190.

FIG. 19*a* shows the disposition of the ring after it was turned counterclockwise by finger 92 and the hook has been pivoted until its disconnection from the key. FIG. 19*b* shows how the key is grabbed by the hook again after the ring has been turned in a clockwise direction.

In accordance with the present invention, it is advantageous to install a small light bulb 301 in the cavity 300 formed in the frontal portion of the housing. The bulb is connected, through wirings W1, W2, with battery 302 installed in corresponding niche 302' in the rear plug 60. A switching means 303 mounted in the opening 304 in the plug is also provided. The switching means can be accessed via window 900 which is located in the rear portion of the housing. It can also be advantageous to replace closure 60' by a detachable compartment 600 which carries a remote control and/or alarm means 601 connected to the autonomous source of energy 602 and signal lamp 603.

The second preferred embodiment of the assembly according to the present invention will now be described with reference to FIGS. 32–44.

This embodiment is based on the same principle of operation, namely revolving of the key retaining drum until one of its storage stations with selected key approaches the working position and is aligned with the key exit opening, and then effecting of the key advancing means in order to move the key out of the assembly.

According to this embodiment, the main components of the retaining assembly include the elongated housing 150 which is closed at its frontal and rear ends by covers 155, 160, a retaining drum 250, which is mounted inside the housing and can be revolved about the longitudinal Y—Y axis of the housing, a key advancing means comprising driving ring 290, a set of toothed wheels 291–295, axle 297, retractor 210, provided with hook 211, and a driving means consisting of two coiled springs 700, 710 which interact with the retaining drum.

Revolving of the drum can be effected by means of disc 251 interacting, by its toothed opening 252', with the corresponding toothed circumference 252 which is provided on the neck portion of said drum.

Access to disc 251, as well as to driving ring 290, is possible via window 5' in the frontal extremity of the housing.

Figure 41:
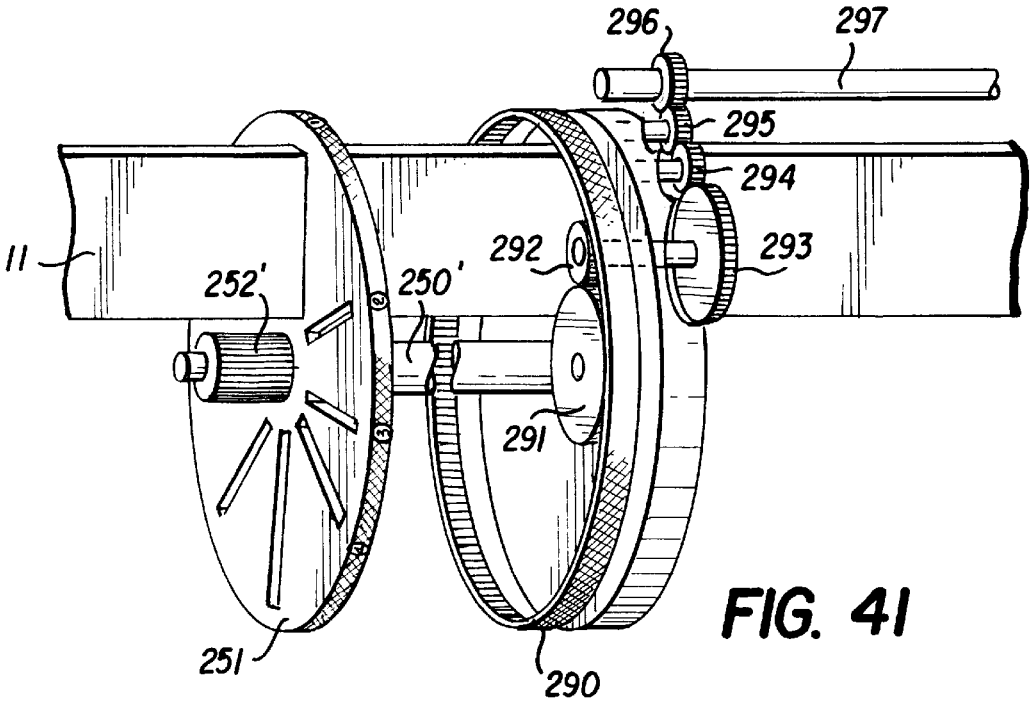
FIG. 41 is a partial isometrical view showing the interaction of the driving disc with selected key and the transfer of rotary motion from the inwardly facing toothed surface of the driving ring to the axle of the key advancing means.
Figure 33A:
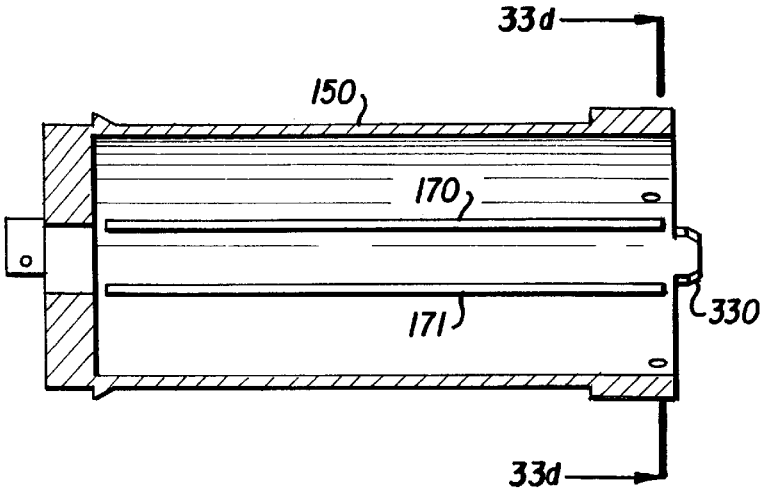
FIGS. 33*a,b* show cross-sectional and outside frontal views, respectively, of the housing employed in the assembly, according to the second preferred embodiment of the present invention.
Figure 33B:
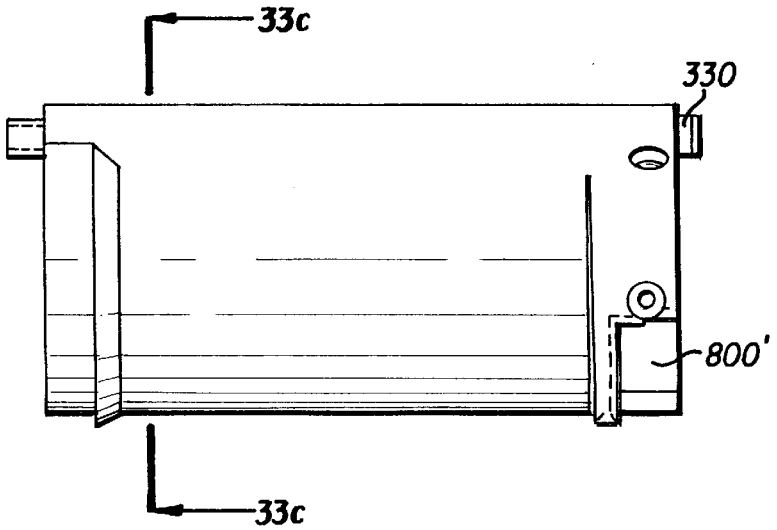
FIG. 33*c* shows a partial cross-sectional view of the frontal portion of the housing, taken along line C—C, as shown in FIG. 33*b*.
FIG. 33*d* shows a cross-sectional fragmented view of FIG. 33*a*, taken along line D—D.
Figure 33C:
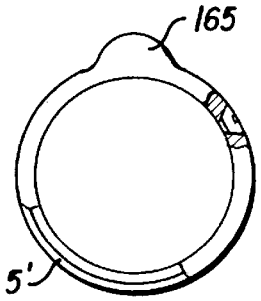
Figure 33D:
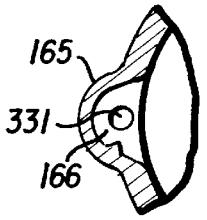

The outside facing circumference of the housing is formed with elevation 165 which extends along the housing and provides inside room 166 for mounting of the axle 290. As can be seen in FIGS. 31,41, by virtue of this room, disposition of the axle, unlike in the previous embodiment, becomes eccentric with respect to the longitudinal axes Y—Y of the housing.

Appropriate openings 330,331 are provided for mounting of the axle at the frontal and rear extremities the housing. The inwardly facing surface of said room 166 is formed with two longitudinally extending projections 170, 171; mating depressions 170',170' are provided on the retractor and interact with said projections so as to enable guiding of the extractor along the axle in response to its rotation.

The frontal extremity of the housing is provided with depressions 293',294',295' for placement of toothed wheels of the key advancing means. The rear extremity of the housing has opening 800' which enables access to knob 83' of the locking member.

The viewing opening 110 is found on the frontal cover 155 and enables identifying which of the storing stations has presently approached the working position, according to digits 100 of disc 251, as seen through this window.

Figure 34A:
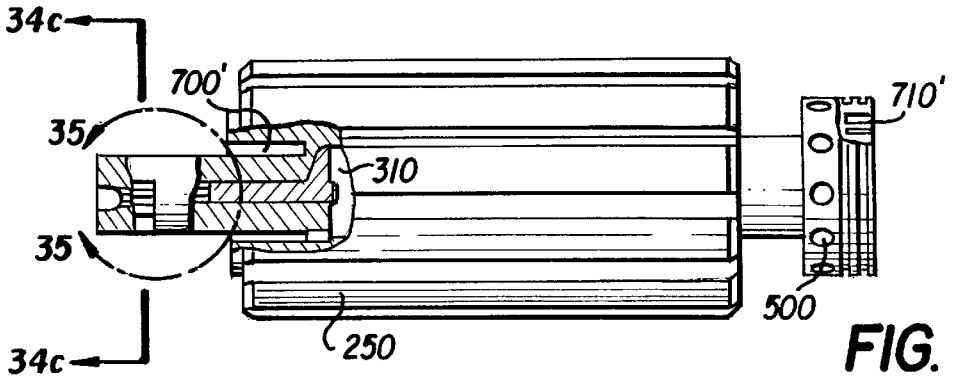
FIGS. 34*a,b* show front and left side views, respectively, of the key retaining means according to the second preferred embodiment of the present invention.
Figure 34B:
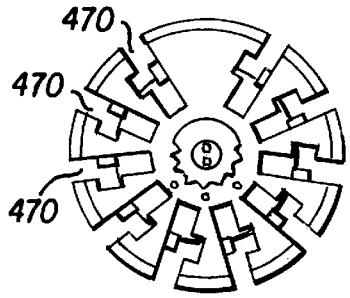
FIG. 34*c* shows a cross-sectional view of FIG. 34*a*, taken along line A—A.
Figure 34C:
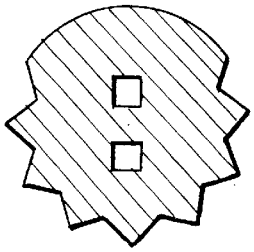
Figure 35:
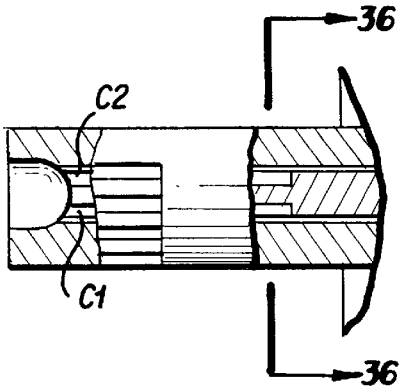
FIG. 35 shows an enlarged cross-sectional view of fragment I, which is circled in FIG. 34*a*.
Figure 36:
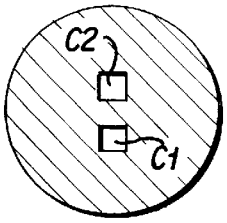
FIG. 36 is a cross-sectional view of FIG. 35, taken along line E—E.
Figure 37C:
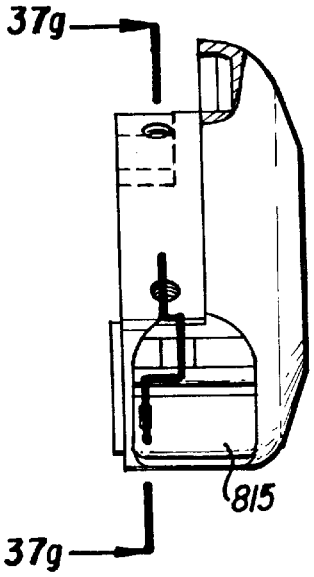
FIGS. 37*a,b,c* present the left side, frontal and right side views, respectively, of the rear cover mounted on the housing, as shown in FIG. 33*a*.
FIGS. 37*d,e,g* show cross-sectional views of FIGS. 37*e* and 37*b*, taken along lines D—D, E—E and C–G, respectively.
Figure 37D:
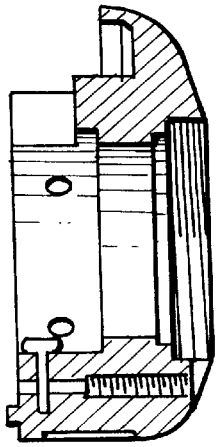
Figure 37E:
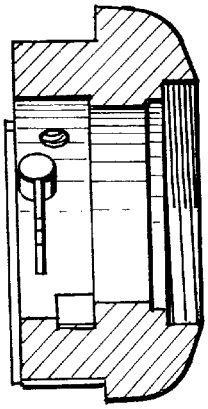
Figure 37G:
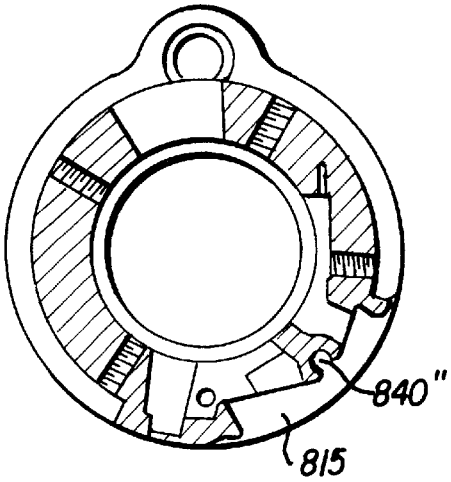

As seen in FIGS. 31,34*a*, coiled springs 700,710 are located at different extremities of drum 250, spring 700 is placed inside circular groove 700' which is formed around neck portion 250', while spring 710 is placed in the rear cover 160 and is fixed in the appropriate hollow 710' formed in the rear portion of the drum. Both springs are assembled in a manner similar to that described above with reference to the first embodiment; however, by virtue of their separate disposition, they interact independently with different portions of the drum.

Retaining drum 250 is slotted by the plurality of receiving slots 470 longitudinally extending along the drum and opening toward its circumference. These slots serve as storing stations for keys to be retained in the assembly. The cross-sectional configuration of these slots is similar to that described with reference to the storing stations employed in the first embodiment.

Corresponding openings 253 are also provided on disc 251 so as to allow exit of keys from the drum out of the assembly to a use position.

The rear extremity of the drum is formed with a plurality of depressions 500, arranged vis-a-vis each slot of the storing stations.

Figure 38:
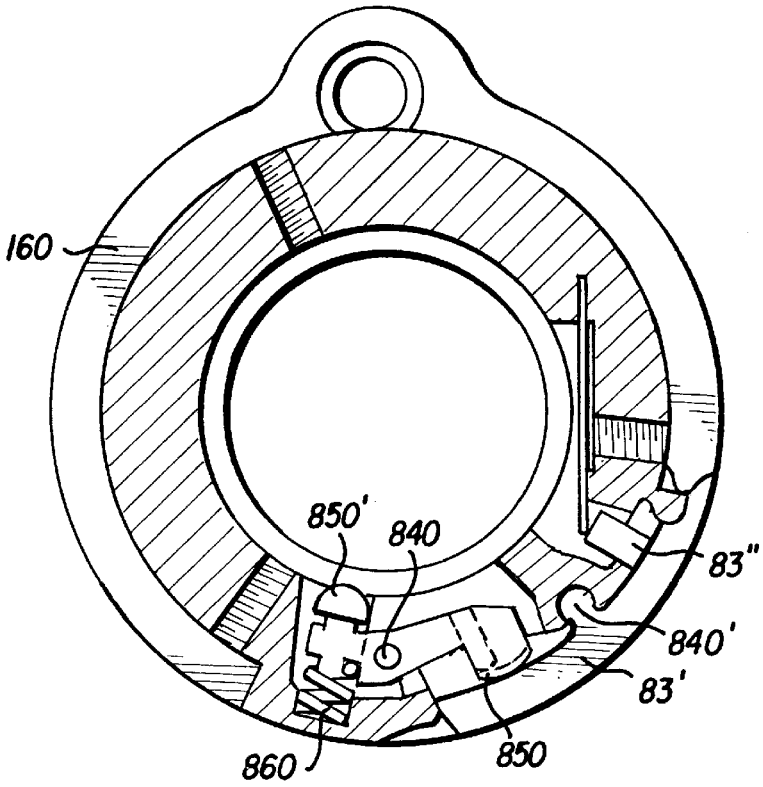
FIG. 38 is an enlarged cross-sectional view of the rear cover shown in FIG. 37*g*, together with a locking member.

FIG. 38 shows that the locking means employed in the second embodiment is formed as lever arm 850 mounted inside niche 815 formed in rear cover 160. The lever arm is placed adjacent to the rear extremity of the drum opposite to that depression of the drum which corresponds to the storing station currently brought into alignment with the exit opening.

The arm is formed with tip 850', and the loading spring 860 presses the tip into depression 500 so as to lock the retaining drum.

The lever arm is pivotably mounted on axis 840 and can be pivoted about it by pressing knob 83' which is accessible through opening 800' in the housing. Pivoting of the arm moves the tip out of the depression and releases the drum. The knob is formed with integral hinge 840' which is inserted inside the appropriate opening 840' in the rear cover so that the knob pivots when it is pressed.

As with the first embodiment, it can be advantageous to provide the assembly with a light bulb 301' installed in the opening formed in the front cover. The bulb is connected, via the appropriate wiring, with a battery 302' situated longitudinally inside the cylindrical opening 310 provided in the drum. Contact 83', located on the knob, serves as the on/off switch for the bulb when the knob is pressed and pivoted about hinge 840'.

The functioning of separating means employed in the second embodiment will now be explained with reference to FIGS. 42 and 44*a,b*.

This means comprises a flat spring 910 firmly connected to a hinge 920 and placed inside an arched groove 910' provided in the housing adjacent to frontal covering 155. The spring can be accessed from the outside through the appropriate opening in the housing (not shown), e.g., by a screwdriver, and moved along the groove. The spring is situated between guiding projection 170 and frontal covering in such a manner that, when the retractor approaches the most forward position, one of its depressions 170' leaves the guiding projection 170 and passes over to hinge 920.

FIG. 44*b* shows key 11 after it has been advanced by retractor 210 to the use position. The key remains in this position being grabbed by hook 211. If the hook is now pivoted about axle 290 in the direction as shown by arrow A, it will be disconnected from opening 14 provided in the key and, therefore, it will be possible to remove the key from the assembly and replace it with another key.

In order to achieve this pivoting action spring 910 is displaced by a screwdriver together with hinge 920 along arrow B, as shown in FIG. 44*a*. After the new key is inserted in the receiving slot, the spring is displaced by the screwdriver in the opposite direction, while pivoting the retractor and urging the hook to grab the opening of the new key.

Figure 45:
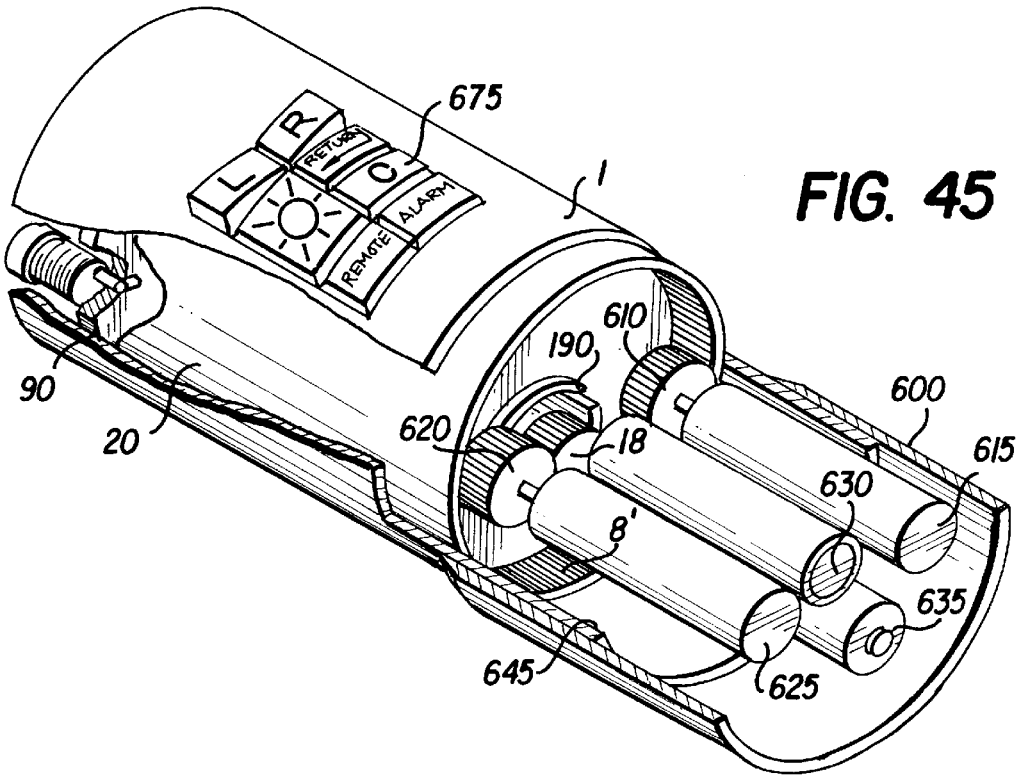
FIG. 45 is an enlarged isometric view of the assembly according to another preferred embodiment which employs miniature motors for driving of key-retaining and key-advancing means.
Figure 40A:
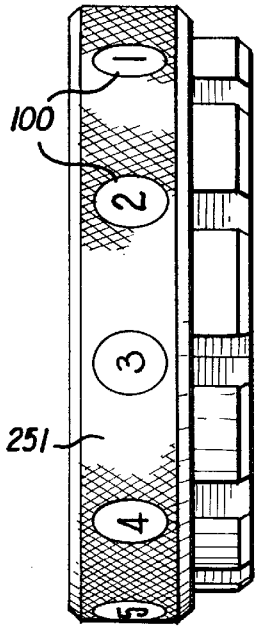
FIGS. 40*a,b* show frontal and left side views, respectively, of the driving disc employed in the second preferred embodiment of the present invention for rotating of the key retaining means.
Figure 40B:
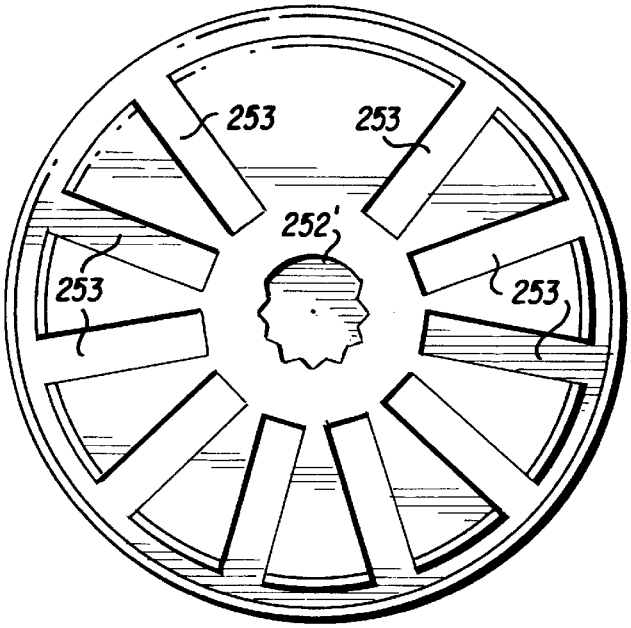
Figure 39:
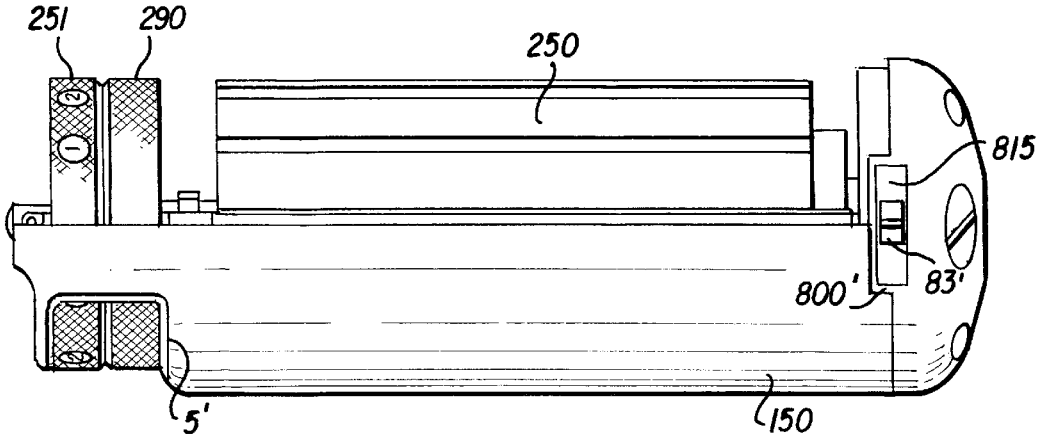
FIG. 39 shows the housing together with key retaining means according to the second preferred embodiment of the present invention.
Figure 46:
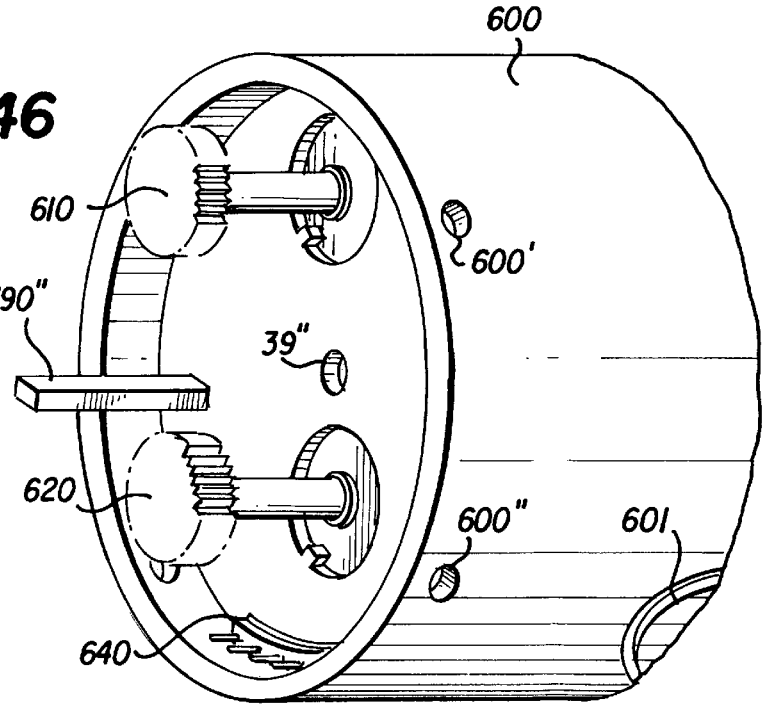
FIG. 46 shows the detachable compartment in which the miniature motors, shown in FIG. 45, are mounted.
Figure 47:
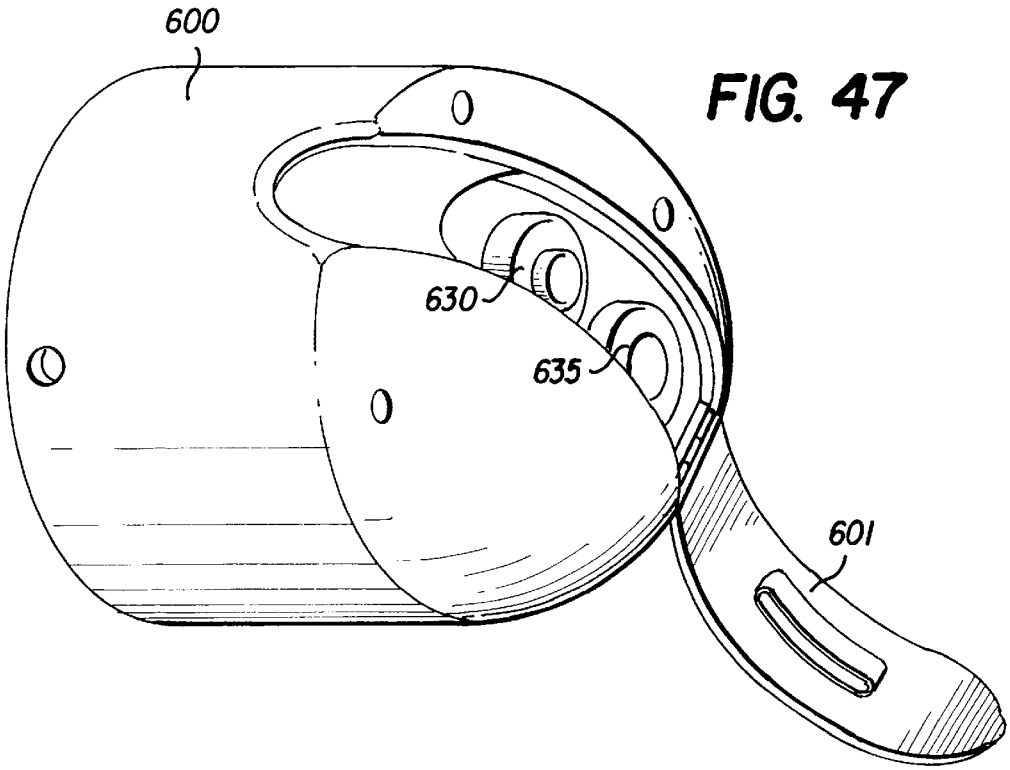
FIG. 47 shows the rear view of the detachable compartment shown in FIG. 46.

The third embodiment of the present invention will now be described with reference to FIGS. 45–47. Most of the components employed in this embodiment are similar to the first embodiment, e.g., the elongated cylindrical housing 1, provided with slotted guiding tube 190, key retaining drum 20, separating disc 90 and eccentric screw 91.

The key advancing means employed in this embodiment is not shown, but it should be understood that it is also present and is similar to that described with reference to the first embodiment.

The driving means employed in this embodiment is different, and by virtue of its constructional features, interacts both with the key retaining drum and the key advancing means. This driving means comprises two miniature motors 615, 625, installed inside compartment 600 and energized by two batteries 630,635. On the circumference of this compartment, there are holes 600', 600' for screws, which fix this compartment to the rear part of the housing, and there is the guiding pin 190' which is to be inserted in a slot of tubular element 190' when the compartment is assembled in the housing.

Each of the motors carries its own pinion 610,620, which correspondingly meshes with the inwardly facing toothed surface 81, which is found on the rear portion of retaining drum 20, and with a pinion 18 which belongs to the axle of the key advancing means. The axle is mounted in the cylindrical recess 39' provided in the compartment.

By virtue of motors 615,625, rotation of the key retaining drum and the axle can be achieved.

The rear side of the compartment is covered by closure 601, and provides access to batteries 630,635 when they need to be replaced.

The appropriate electronic schematic (not shown), which enables the independent operation of both motors, is placed inside compartment 600. The schematic is provided with connecting pins 640 which are plugged in the appropriate contact openings 645 in the rear portion of the housing. This schematic can be energized by the same batteries 630,635.

Contact openings are wired with control panel 675 on the circumference of the housing, and said panel is equipped with a series of knobs which enable easy operation of both motors.

Each time knob L or R is pressed, the drum is rotated clockwise or counterclockwise by motor 615 until a new storing station approaches the working position and is aligned with the exit opening. The electronic schematic is to be chosen so as to allow programmable operation of motor 615 in the sense that, if knob L or R is pressed a particular number of times, it ensures that a particular storing station moves to the working position and becomes aligned with the exit opening. Since each storing station is identified by its own number, fast and simple identification of the desired key and its selection is ensured by pressing the L or K knob a particular number of times corresponding to this number. Therefore, selection of the desired key can be possible without visual contact.

After the selected storing station is aligned with the exit opening, motor 615 stops and the retaining drum is fixed in this position by virtue of the toothed surface 8', which gears with pinion 610. The RETURN knob, which is found on the control panel, can then be pressed, enabling operation of motor 625 and effecting the key advancing means.

As in the previous embodiments, it is advantageous to provide the assembly with a light bulb as well as remote control and alarm means, which are switched on or off by the appropriate separate knobs provided on the same control panel.

Figure 48:
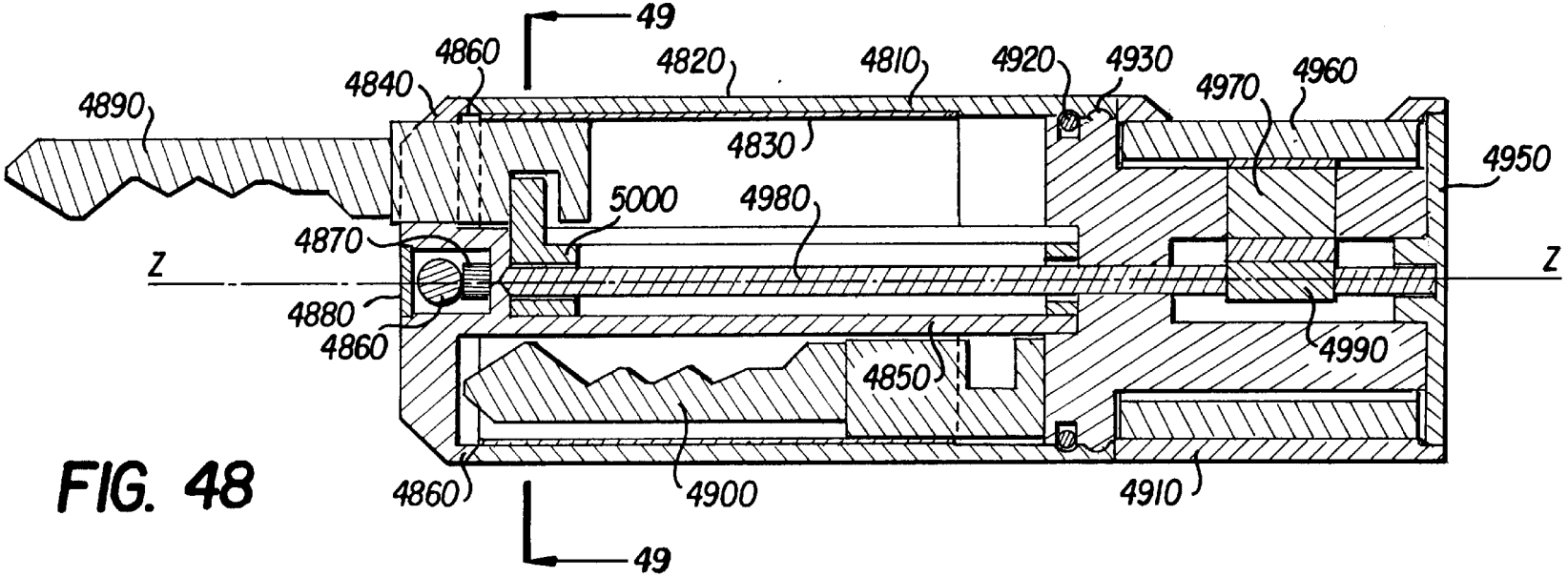
FIG. 48 is a longitudinal, cross-sectional view of a key assembly in accordance with a further embodiment of the invention.
Figure 49:
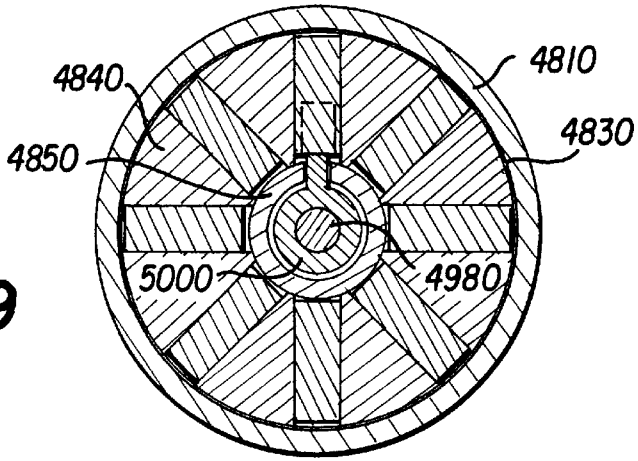
FIG. 49 is a transverse, cross-sectional view of the key assembly taken along lines 49—49 in FIG. 48.

In addition to the previously described embodiments, disclosing an assembly provided with key retaining mechanism mounted within a housing with the possibility of revolving with respect thereto, an additional embodiment will now be described. Specifically, FIG. 48 is a longitudinal cross-sectional view of a key assembly in accordance with the further embodiment of the invention, and FIG. 49 is a transverse cross-sectional view of a key assembly taken along the lines 49—49 of FIG. 48.

As can be seen in the aforementioned figures, a key assembly in accordance with this embodiment of the invention also includes an elongated housing 4810, the outwardly facing surface 4820 of which can be grasped by hand of the user (not shown). The housing 4810 is formed as a tubular member extending along the axis Z—Z (in FIG. 48), and comprising a frontal, central and rear portion. Formed as a drum, the key retaining mechanism 4830 is mounted within the housing, and is provided with a plurality of storing stations for retaining a plurality of keys. The outwardly facing cylindrical surface of the drum is secured (for example, by gluing) on the inwardly facing cylindrical surface of the housing 4810. By virtue of this provision, the drum can be revolved along the axis Z—Z together with the housing, if rotation of the latter is effected by the grasping hand of the user.

Within the key retaining mechanism, there is mounted a frontal member, including a frontal portion 4840, provided with a key exit opening (not shown) and an elongated slotted tubular portion 4850. The frontal portion 4840 of the frontal member is secured on the frontal portion of the housing (for example, by means of elastic snaps 4860) and functions as a frontal closure of the assembly, while the tubular portion thereof extends along the axis Z—Z. By virtue of this provision, the housing together with the drum can be revolved along the slotted tubular portion 4850, and thus the chosen key storing station can be aligned with the key exit opening.

In the middle of the frontal portion 4840, there is provided a room for placement of a small light bulb 4860', energized by a battery 4870. The room is closed by a glass shield 4880. Each of the keys disposed within storing stations can be moved forward and backward along its respective station when it aligned with the key exit opening. In FIG. 48, there is shown a key 4890 after it has been moved from the storing station and advanced up to its forward ready-to-use position, while the other key 4900 remains in the backward position within the storing station.

There is also provided a rear member 4910 which is attached to the inwardly facing surface of the rear portion of the housing, and which is secured thereon (for example, by means of a elastic ring 4920). By virtue of this connection, there is provided the possibility of revolving of the housing with respect to the rear member. On the outwardly facing surface of the rear member, there are provided projections 4930 mating with corresponding depressions formed on the inwardly facing surface of the housing, and constituting part of the locking mechanism for fixation of the housing together with the drum in an arbitrary position.

The rearmost portion of the rear member is closed by a rear cover 4950. The rear member carries the outside toothed ring 4960, meshing with the intermediate toothed wheel 4970. The outside ring can be approached by the user's hand, and thus rotation thereof can be easily effected.

A longitudinal threaded axle 4980 is also provided, and it is mounted within the housing between the frontal portion 4840 of the frontal member and the rearmost position of the rear member 4910. The axle 4980 extends along the slotted tubular portion of the frontal member, and is mounted within the housing with the possibility of rotation. Rotation of the axle 4980 can be effected by virtue of a toothed wheel 4990 rigidly mounted thereon and meshing with the intermediate toothed wheel 4970.

An L-shaped retractor 5000 is also provided, and it cooperates with a key. The retractor 5000 is formed with an inner through-going threaded bore enabling mounting thereof on the axle, with the possibility of linear and pivotal movement with respect thereto. In view of the fact that the thread of the axle matches that of the bore of the retractor 5000, linear movement of the retractor 5000 is achieved once rotation of the outside ring 4960 is effected. The slot formed within the tubular portion 4850 functions as a guiding mechanism for the retractor 5000 moving thereal-ong.

In order to advance the chosen key into a ready-to-use position, one should revolve the housing so as to align a respective storing station with a key exit opening. Upon alignment, one should revolve the outside ring on the rear member so as to advance the key. In order to return the key into its storing station and to disengage the retractor 5000, one should revolve the outside ring in the reverse direction and then revolve the housing. Although not specifically shown, it should be understood that a disconnecting mechanism can be provided for disengaging the retractor 5000 from the key once it is moved out of the exit opening.

It should be readily understood that, in general, the described additional embodiment includes the same features as described with respect to previous embodiments, that it, a key retaining mechanism, a key advancing and retracting mechanism, and a guiding mechanism. Functioning of the assembly according to this embodiment is also very similar to the functioning of the previously disclosed embodiments.

The present invention should not be limited to the above preferred embodiments; it should be understood that changes and modifications can be made by anyone skilled in the art, without deviation from the scope of the invention, so as to make it suitable for retention of other types of keys, e.g., those with a magnetic band instead of wards, or for retention of other similarly shaped objects used to carry out work manually, like screwdrivers, torque keys or other instruments.

The scope of the invention is defined in the appended claims.

What is claimed is:

1. A key assembly comprising:

an elongated housing having a front, a back, an inner surface, and a longitudinal axis;

a key retaining means inserted within said housing and rotatable with said housing, said key retaining means having storing stations for housing keys;

and a key advancing and retracting means mounted within and connected to said housing for advancing said keys through an opening defined in said front of said housing;

wherein said key advancing and retracting means comprises a rear member secured to said back of said housing by a securing means for allowing rotation of said rear member relative to said housing, an axle rotatably mounted within said housing and extending from said rear member toward said front of said housing, a retractor mounted on said axle for linear and pivotal movement with respect thereto, and a gear mechanism positioned in said rear member between said axle and an inner surface of said rear member for rotating said axle when said rear member is rotated.

2. The assembly of claim 1, wherein said key retaining means is a drum.

3. The assembly of claim 1, further comprising a frontal member mounted to said front of said housing, said frontal member having a frontal portion with said opening provided therein and a generally tubular portion extending therefrom, said frontal portion connected to said front of said housing for rotation with said housing and said tubular portion extending into said key retaining mechanism and toward said back of said housing.

4. The assembly of claim 3, further comprising a light-producing means positioned in said frontal portion of said frontal member.

5. The assembly of claim 4, wherein said light-producing means further comprises a light bulb and a battery electrically connected to said light bulb.

6. The assembly of claim 4, further comprising a transparent shield positioned in said frontal portion and overlying said light-producing means.

7. The assembly of claim 3, wherein said frontal member is connected to said housing by elastic snaps.

8. The assembly of claim 1, wherein said securing means is an elastic ring.

9. The assembly of claim 1, further comprising a locking means for arresting rotation of said housing relative to said rear member.

10. The assembly of claim 9, wherein said locking means comprises projections provided along an outer surface of said rear member and complementary depressions provided along said inner surface of said housing.

11. The assembly of claim 1, wherein said key advancing and retracting means further comprises an axle rotatably mounted within said housing and extending from said rear member toward said front of said housing, a retractor mounted on said axle for linear and pivotal movement with respect thereto, and a gear mechanism positioned in said rear member between said axle and an inner surface of said rear member.

12. The assembly of claim 11, wherein said gear mechanism comprises an outside toothed ring mounted on said rear member, a pinion mounted on said axle, and an intermediate toothed wheel positioned for engagement with said pinion and said toothed ring.

13. The assembly of claim 1, further including connecting means for providing rotation of said key retaining means with said housing.

14. The assembly of claim 13, wherein said connecting means is secured to said housing by glue.

* * * * *